US006380964B1

(12) United States Patent
Tanaka

(10) Patent No.: US 6,380,964 B1
(45) Date of Patent: Apr. 30, 2002

(54) THERMAL TRANSFER RECORDING APPARATUS

(75) Inventor: Hironori Tanaka, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/379,638

(22) Filed: Aug. 24, 1999

(30) Foreign Application Priority Data

Aug. 24, 1998 (JP) ..... 10-236724

(51) Int. Cl.[7] ..... B41J 2/325
(52) U.S. Cl. ..... 347/217
(58) Field of Search ..... 347/215, 216, 347/217; 400/208

(56) References Cited

U.S. PATENT DOCUMENTS 5,164,744 A * 11/1992 Yoshida et al. ..... 347/217
5,800,084 A * 9/1998 Sawada et al. ..... 347/217

FOREIGN PATENT DOCUMENTS

EP 0884188 * 12/1998 ..... B41J/2/325
EP 0 884 188 A2 12/1998
JP 4-25486 A 1/1992
JP 4-148971 A 5/1992
JP 407178993 * 7/1995 ..... B41J/17/30
JP 7-266649 A 10/1995
JP 08318656 * 12/1996 ..... B41J/17/30
JP 09272239 * 10/1997 ..... B41J/17/30

OTHER PUBLICATIONS

Patent Abstracts of Japan, vol. 1997, No. 4, Apr. 30, 1997 & JP 08 318656 A (Graphtec Corp), Dec. 3, 1996.
Patent Abstracts of Japan, vol. 1997, No. 6, Jun. 30, 1997 & JP 09 039349 A (Graphite Corp), Feb. 10, 1997.

* cited by examiner

*Primary Examiner*—N. Le
*Assistant Examiner*—K. Feggins
(74) *Attorney, Agent, or Firm*—Nixon & Vanderhye P.C.

(57) ABSTRACT

The present invention is directed to a thermal transfer recording apparatus, and an object is to prevent causes of print failure, such as wrinkling and transport failure of an ink sheet, resulting from the partial shrinking of the ink sheet due to the heating of the thermal head during printing. The thermal transfer recording apparatus of the present invention comprises a thermal head and a platen roller opposed to the thermal head, and prints on a sheet by causing a wax, a sublimation dye, or the like applied on the ink sheet to melt or sublime by the heat of the thermal head. The thermal transfer recording apparatus is constructed so that the take-up tensile force applied to the ink sheet is made greater at both edges of the ink sheet than at the center thereof.

17 Claims, 9 Drawing Sheets

THERMAL TRANSFER RECORDING APPARATUS

BACKGROUND OF THE INVENTION

1. Field of the Invention

The present invention relates to a thermal transfer recording apparatus equipped with an ink sheet, for transferring wax or the like of the ink sheet onto paper.

2. Description of the Related Art

Printing apparatuses of the type that transfers wax or the like from an ink sheet onto paper by utilizing the heat of a thermal head are ubiquitously used as word processor printers, facsimile printing apparatuses, and the like. Of such printers, specifically, the type of printer that prints one line at a time widthwise on an A4, B4, or like-size sheet requires the use of a wide ink sheet which is prone to partially shrink due to heating during printing, thus tending to cause ink sheet transport failure and print failure. Various methods of correction using a sheet correcting plate, etc. have been tried to address the problem, but none of them have been successful in providing a perfect preventive measure.

Japanese Unexamined Patent Publication JP-A 4-148971 (1992) discloses a method in which ribbon guide rollers so arranged as to be able to align an ink ribbon (ink sheet) at the center are provided in the transport path of the ink ribbon to prevent wrinkling from occurring during recording and thereby to obtain high quality recording results. Further, Japanese Unexamined Patent Publication JP-A 4-25486 (1992) discloses a method in which an electrically conductive elastic member is provided in the transport path of the ink ribbon to ensure stable transport of the ink ribbon, thereby preventing image degradation from occurring due to wrinkling or slacking of the ink ribbon. On the other hand, Japanese Unexamined Patent Publication JP-A 7-266649 (1995) discloses a method in which the portion of a separation member which contacts the center portion of a thermal transfer ribbon is curved downward relative to both edges thereof, thereby absorbing relative stretching at the edges of the thermal transfer ribbon.

Printing techniques for transferring wax from an ink sheet onto paper by the heating of a thermal head are widely used. Specifically, when printing one line at a time along the width of a commonly used sheet such as an A4- or B4-size sheet, the width of the ink sheet is made equal to the length of the shorter side of the A4 or B4 size, for example.

During printing, the ink sheet partially shrinks due to the heat of the thermal head, as a result of which wrinkles are formed in the ink sheet and transport failure occurs, causing print failure. In particular, in the-case of a wide ink sheet, it is difficult to eliminate such print failure, and a measure that can perfectly prevent it has yet to be devised.

SUMMARY OF THE INVENTION

An object of the present invention is to prevent the causes of print failure, such as wrinkling and transport failure of the ink sheet, resulting from the partial shrinking of the ink sheet due to the heating of the thermal head during printing.

In a first aspect, the invention provides a thermal transfer recording apparatus comprising:

a thermal head (31); and a platen roller (110) opposed to the thermal head (31), the thermal transfer recording apparatus carrying out printing on a sheet (P) by causing a wax, a sublimation dye, or the like applied on an ink sheet (42) to melt or sublime by the heat of the thermal head (31), the ink sheet (42) being transported between the thermal head (31) and the platen roller (110), wherein a tensile force applied to a portion of the ink sheet (42) which lies downstream of the thermal head (31) as viewed along a direction of ink sheet travel (d) is greater at both edges of the ink sheet (42) than at the center thereof.

According to the invention, the thermal transfer recording apparatus, comprising the thermal head and the platen roller opposed to the thermal head, prints on a sheet by causing a wax, a sublimation dye, or the like applied on the ink sheet to melt or sublime by the heat of the thermal head. In this thermal transfer recording apparatus, the take-up tensile force applied to the ink sheet is greater at both edges of the ink sheet than at the center thereof. With this arrangement, since vector components directed from the center toward both edges occur in the ink sheet tensile force, the ink sheet can be prevented from wrinkling due to the shrinking of the ink sheet caused by printing heat. Accordingly, the thermal transfer recording apparatus can prevent print failure and ink sheet transport failure.

In a second aspect of the invention, it is preferable that the thermal transfer recording apparatus further comprises a friction member for tensioning the ink sheet by applying friction to the ink sheet, wherein the friction member is disposed downstream of the thermal head as viewed along the direction of travel, a contact face of the friction member that is brought into contact with the ink sheet extends along full width of the ink sheet, and a coefficient of friction at a center portion of the contact face of the friction member is higher than a coefficient of friction at both end portions of the contact face.

According to the invention, the friction member for frictionally tensioning the ink sheet is disposed downstream of the thermal head as viewed in the direction of ink sheet travel and in such a manner as to extend along the full width of the ink sheet. Further, the coefficient of friction of the contact face of the friction member is higher at the center portion than at both end portions thereof. The thus structured friction member can make the tensile force applied to both widthwise edges of the ink sheet greater than the tensile force applied to the center thereof. Accordingly, the thermal transfer recording apparatus can prevent print failure and ink sheet transport failure.

In a third aspect of the invention, it is preferable that a length of contact along which the center portion of the contact face of the friction member contacts the ink sheet is greater than a length of contact along which each of the end portions of the contact face of the friction member contacts the ink sheet.

According to the invention, the thermal transfer recording apparatus is constructed so that the length of contact along which the friction member for frictionally tensioning the ink sheet contacts the ink sheet is greater at the center than at both end portions. With this structure, the tensile force applied to both edges of the ink sheet can be made greater than that applied to the center thereof.

In a forth aspect of the invention, it is preferable that the length of contact along which each of the end portions of the contact face of the friction member contacts the ink sheet increases with increasing distance from each end of the contact face toward the center thereof.

According to the invention, the friction member can gradually reduce the ink sheet tensile force along the width thereof from both edges toward the center. Accordingly, the thermal transfer recording apparatus can prevent print failure and ink sheet transport failure more effectively.

In a fifth aspect of the invention, it is preferable that both end portions of the contact face of the friction member are each covered with a substance whose coefficient of friction is lower than the coefficient of friction of the center portion of the contact face.

According to the invention, in the thermal transfer recording apparatus, as a method of varying the coefficient of friction of the friction member for frictionally tensioning the ink sheet, a film such as a fluororesin sheet with a low coefficient of friction is glued to each end portion of the friction member, thus coating the end portion with fluororesin or the like. With this structure, the tensile force applied to center of the ink sheet can be made smaller than that applied to both edges thereof.

In a sixth aspect of the invention, it is preferable that the center portion of the contact face of the friction member is covered with a substance whose coefficient of friction is higher than the coefficient of friction of both end portions of the contact face.

In a seventh aspect of the invention, it is preferable that a film made of a substance whose coefficient of friction is higher than the coefficient of friction of both end portions of the contact face of the friction member is glued to the center portion of the contact face.

In an eighth aspect of the invention, it is preferable that the center portion of the contact face of the friction member is treated with surface roughening.

According to the sixth to eighth aspects of the invention, the center portion of the friction member for frictionally tensioning the ink sheet is coated with a substance or a film having a high coefficient of friction or is treated with surface roughening by sand blasting. Since this serves to increase the coefficient of friction of the center portion, the tensile force applied to the center portion of the ink sheet can be reduced compared to that applied to both end portions thereof.

As described above, according to the first to eighth aspects of the invention, by constructing the thermal transfer recording apparatus so that a greater take-up force is applied to both edges of the ink sheet than to the center thereof, vector components directed from the center toward both edges occur in the ink sheet pulling tensile force; this serves to prevent the ink sheet from wrinkling due to the shrinking of the ink sheet caused by printing heat. Accordingly, the thermal transfer recording apparatus can prevent print failure and ink sheet transport failure.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
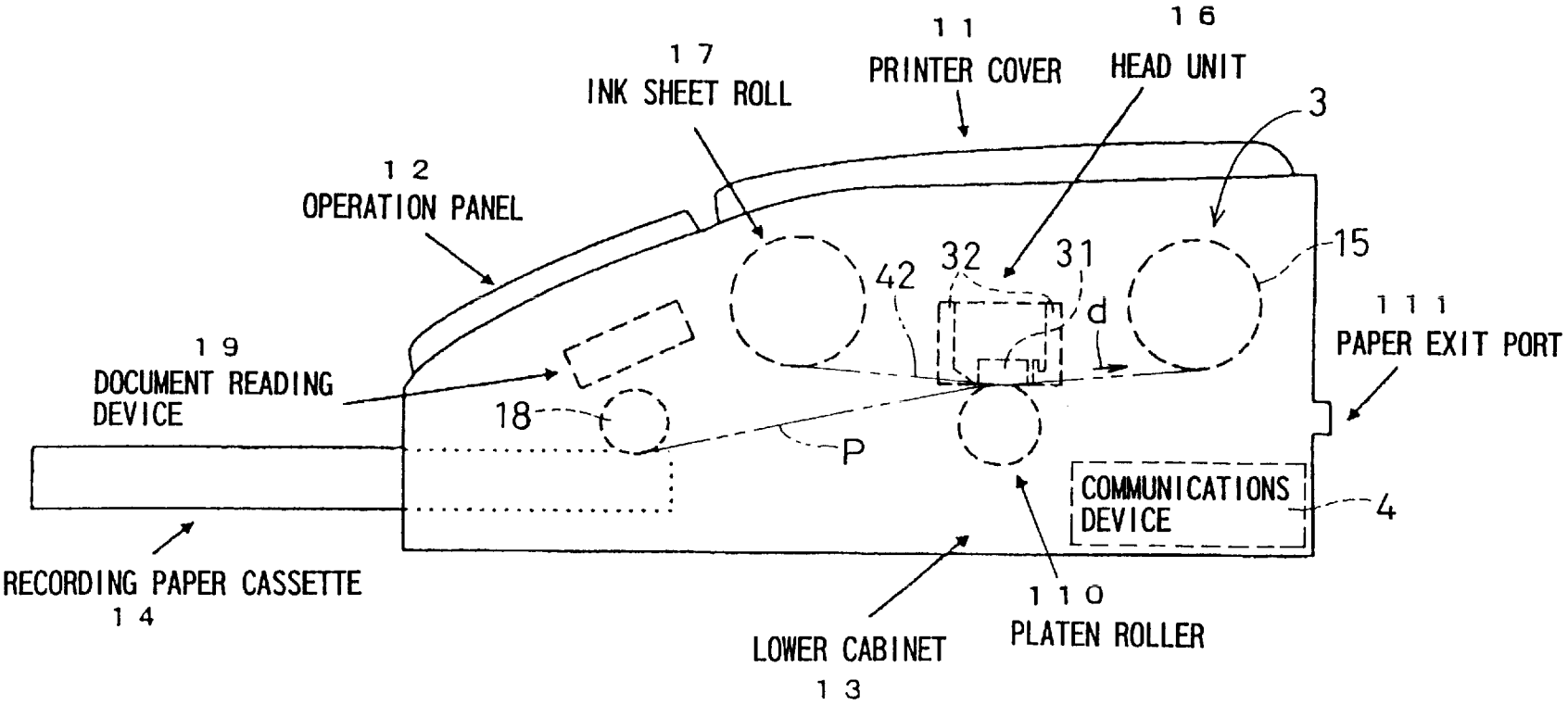
FIG. 1 is a diagram showing the external view of a thermal transfer facsimile apparatus equipped with a thermal transfer recording apparatus 3 according to the present invention, and the arrangement of important units thereof.

Now referring to the drawings, preferred embodiments of the invention are described below.

FIG. 1 is an external view of a thermal transfer facsimile apparatus equipped with a thermal transfer recording apparatus 3 according to the present invention. FIG. 1 also shows the arrangement of important units within the thermal transfer facsimile apparatus. In this specification, those units which are located within the thermal transfer facsimile apparatus but are irrelevant to the present invention are omitted to avoid complexity.

The thermal transfer facsimile apparatus includes, in addition to the thermal transfer recording apparatus 3, an operation panel 12, a recording paper cassette 14, a communications device 4, and a document reading device 19. The thermal transfer recording apparatus 3, the operation panel 12, the communications device 4, and the document reading device 19 are arranged inside the thermal transfer facsimile apparatus. The recording paper cassette 14 is mounted detachably to the facsimile apparatus body. The thermal transfer recording apparatus 3 includes a take-up roller 15, a head unit 16, an ink sheet roll 17, a pick-up roller 18, and a platen roller 110. The ink sheet roll 17 has an unused portion of an ink sheet 42 wound around it. Used portion of the ink sheet 42 is wound around the take-up roller 15. The head unit 16 comprises a thermal head (hereinafter simply referred to as "head") 31 and a head frame 32.

The exterior of the facsimile apparatus body comprises a lower cabinet 13, the operation panel 12, and a printer cover of 11. The recording paper cassette 14, which is capable of holding a plurality of cut sheets of recording paper, is inserted in the apparatus body from the front thereof. The operation panel 12 has a group of dialing buttons, a group of facsimile operation buttons, a display device, etc. and provides a man-machine interface between the facsimile apparatus and the user.

The ink sheet 42 is fed out of the ink sheet roll 17, is passed between the platen roller 110 and the head unit 16, and is wound around the take-up roller 15. In FIG. 1, the feed direction of the ink sheet 42 is indicated by arrow d. The recording paper P is fed from the recording paper cassette 14 one sheet at a time by means of the pick-up roller 18; the sheet is then passed between the platen roller 110 and the head unit 16, and exits from a paper exit port 111. The head 31 in the head unit 16 prints an image on the recording paper using the ink sheet 42 based on image data. The image data here refers to data transmitted from another facsimile apparatus or communications device and received by the communications device 4 or data created by reading a document by the document reading device 19.

Though not shown, documents to be read are stacked on the printer cover, loaded into the apparatus one sheet at a time through the back of the operation panel, read by the document reading device 19, and stacked on a top face of the recording paper cassette 14 inserted in the front.

Figure 2:
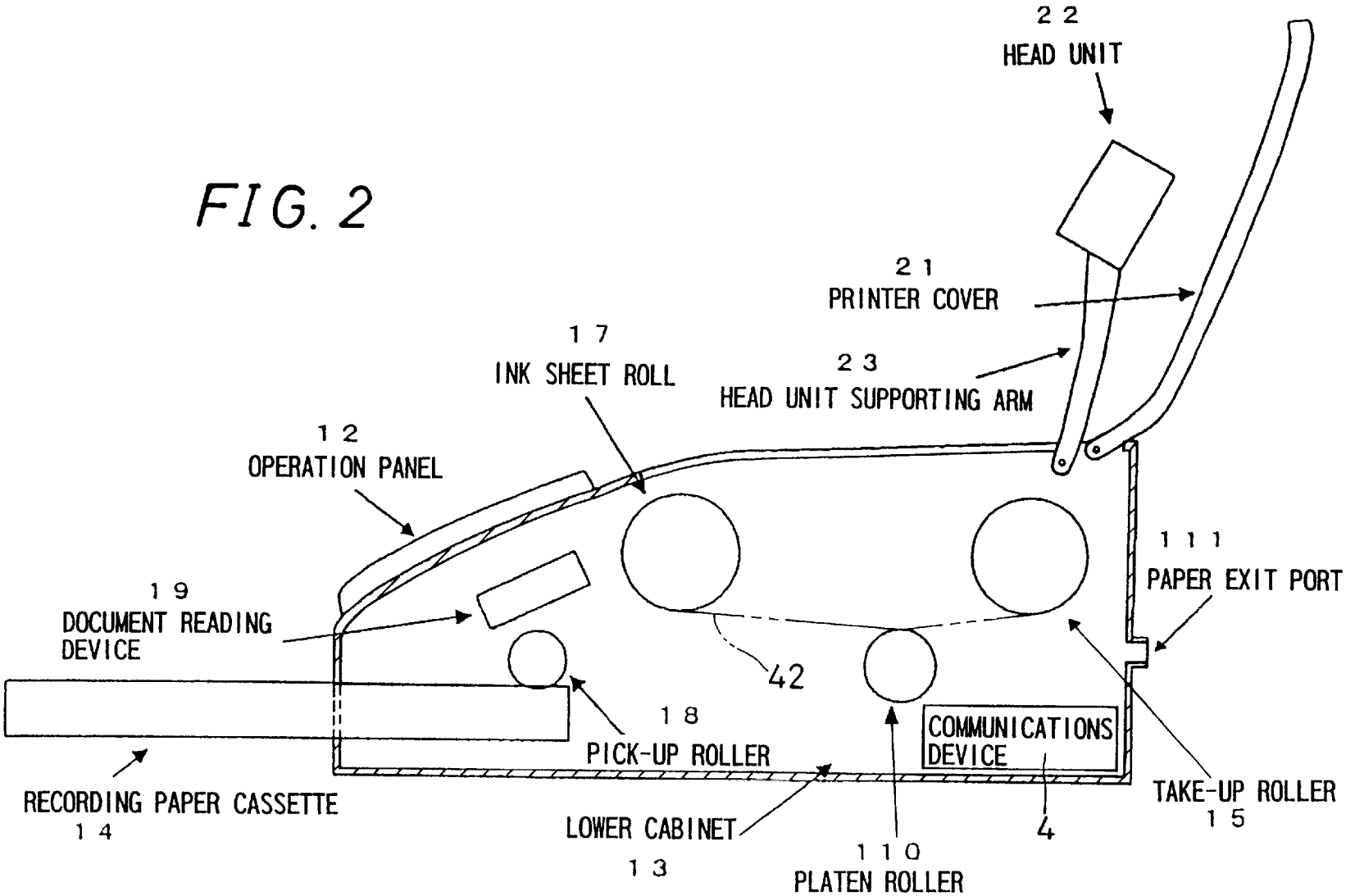
FIG. 2 is a diagram showing the thermal transfer facsimile apparatus of FIG. 1 in a condition in which a printer cover and a head unit are opened.

FIG. 2 is a cross sectional view showing the thermal transfer facsimile apparatus in a condition in which the printer cover 11 is opened to remove jammed recording paper or to replace the ink sheet. As shown in FIG. 2, a printer cover 21 is opened upwardly in the rearward direction, and a head unit 22 is also moved upwardly in the rearward direction by being supported on a head unit supporting arm 23 shown in FIG. 2 but not shown in FIG. 1. In this condition, the ink sheet 42 can be inserted or removed together with the ink sheet roll 17 and the take-up roller 15. This facilitates the removal of jammed paper and the replacement of the ink sheet.

Figure 3:
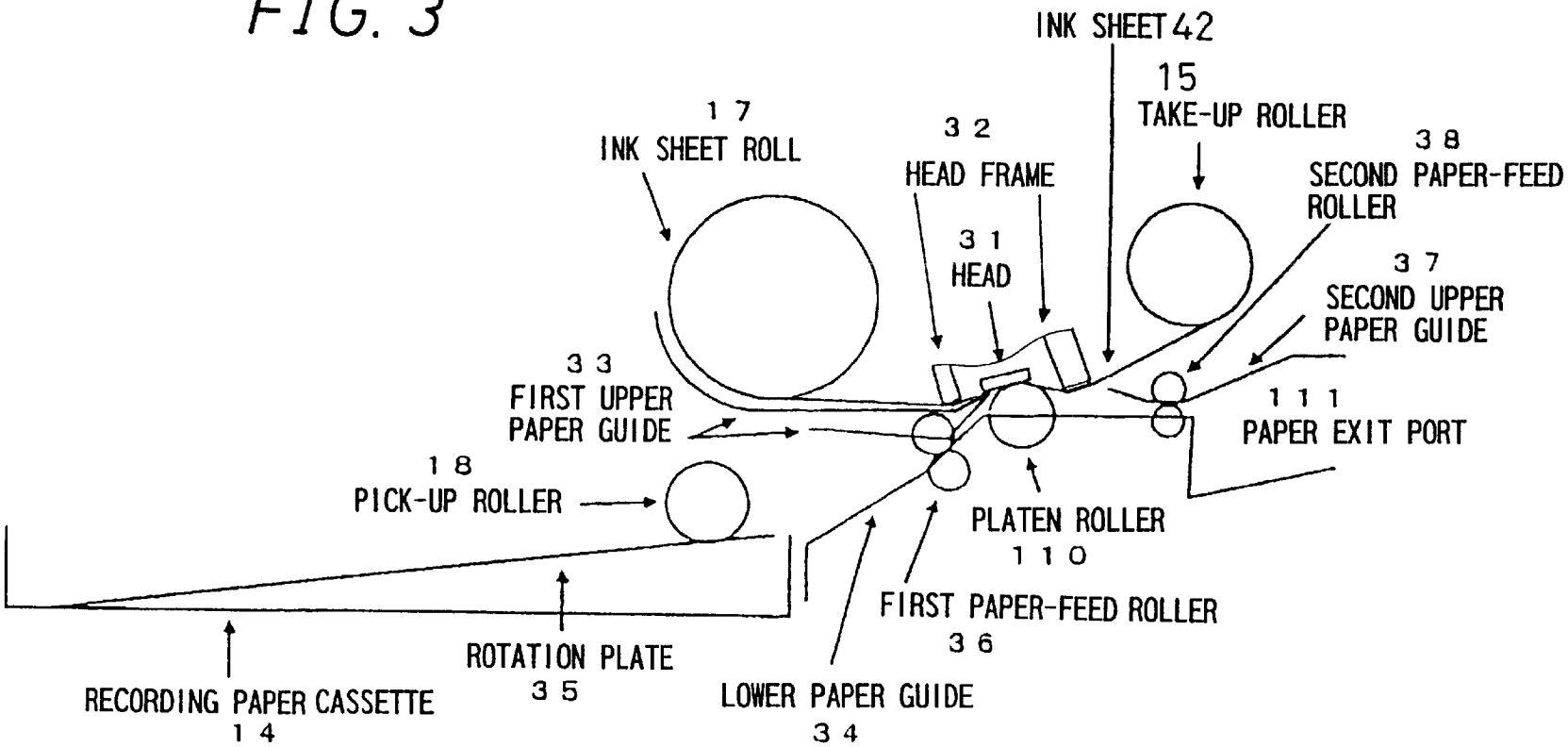
FIG. 3 is a diagram showing in detail a thermal head and its adjacent parts in the thermal transfer facsimile apparatus of FIG. 1.
Figure 4:
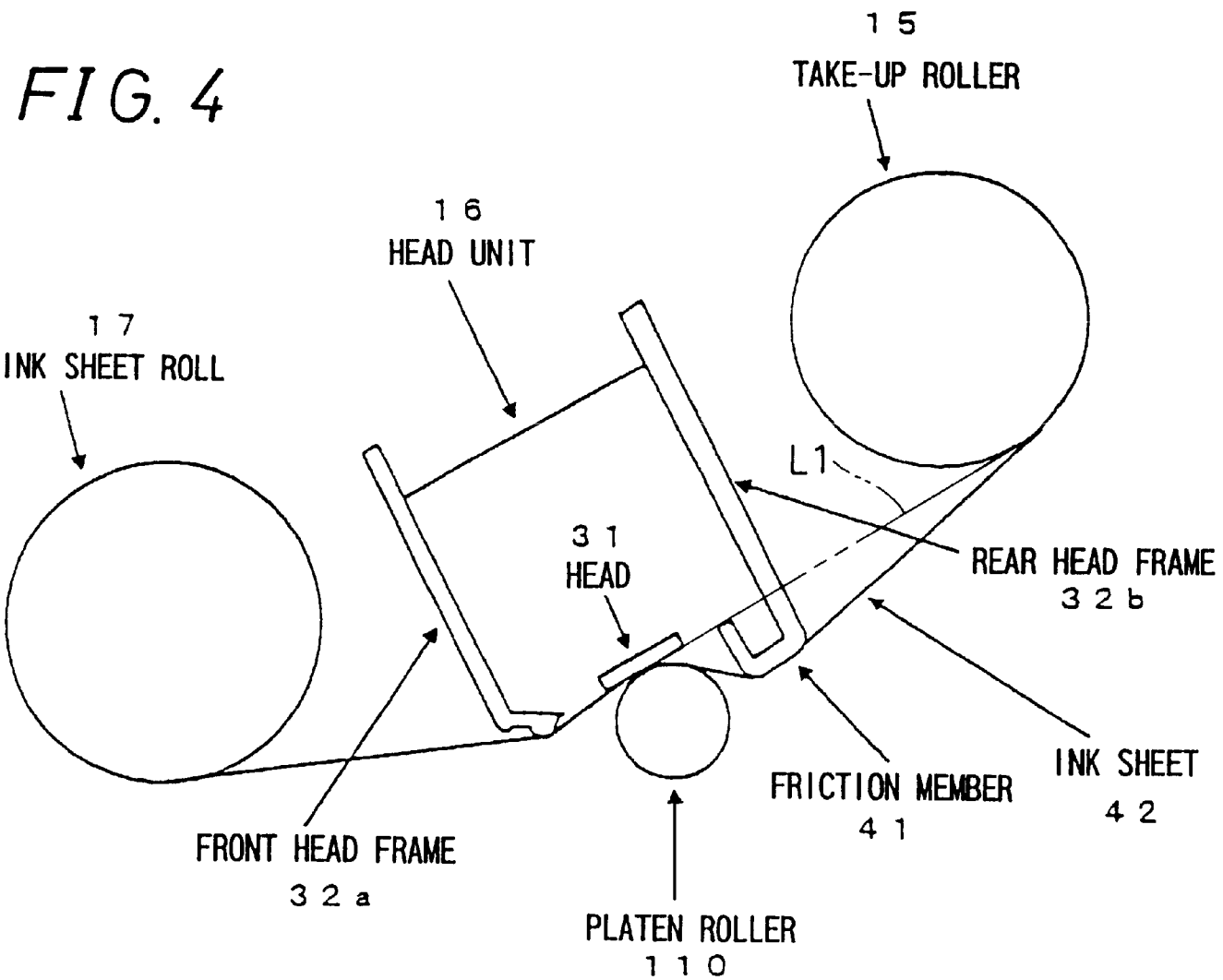
FIG. 4 is an enlarged view of the head unit in the thermal transfer facsimile apparatus of FIG. 1.

FIG. 3 is a diagram showing in detail the thermal head 31 and its adjacent parts, providing a detailed illustration of how the ink sheet and the recording paper are transported within the facsimile apparatus. FIG. 4 is an enlarged view of the head unit 16. The following description is given with reference to FIG. 3 in conjunction with FIG. 4. A plurality of recording paper sheets are loaded into the recording paper cassette 14 and are urged upward by means of a rotation plate 35. Both sides of the leading edge of the recording paper are held by pawls not shown. When the pick-up roller 18 rotates, the top sheet of recording paper is pushed forward and fed with the leading edge riding over the pawls. This mechanism ensures that the recording paper is always fed one sheet at a time. The recording paper thus fed is passed through a pair of first paper-feed rollers 36 by being guided on a lower paper guide 34 and a first upper paper guide 3S, and fed to the position between the platen roller 110 and the head 31.

The head 31 and head frame 32, forming part of the head unit 16, also act to guide the transportation of the recording paper and the ink sheet. The recording paper printed at the position between the head 31 and the platen roller 110 is guided by the lower paper guide 34 and a second paper guide 37 and is transported by a pair of second paper-feed rollers 38 into the paper exit port 111 for discharge outside.

The ink sheet 42, fed out of the ink sheet roll 17, is transported by being guided by a front head frame 32*a*, the head 31, and a rear head frame 32*b*, and is wound around the take-up roller 15. When the recording paper is fed to the position between the head 31 and the platen roller 110, positional relationship at the portion of the head 31 is such that the head 31, the ink sheet 42, the recording paper, and platen roller 110 are stacked from top to bottom in this order. The head 31 has a heater with a heater dot density of eight dots per millimeter, extending along the full width of the recording paper in the depth direction in the plane of FIG. 3, and is pressed toward the platen roller 110 by a spring (not shown) exerting a constant pressure.

By applying a current to the appropriate dots of the heater in accordance with the image data to be printed, only the dots necessary to melt the wax on the ink sheet 42 are heated and the wax is transferred onto the recording paper, thus printing one line at a time. In this way, when the recording paper is fed past the head 31, the printing is completed.

A member 41 for frictionally tensioning the ink sheet 42 (hereinafter called "friction member") may be provided between the rear head frame 32*b* and the take-up roller 15. The simplest construction of the friction member is to use the rear head frame 32*b* itself, at least a portion thereof, as the friction member 41. The description hereinafter given assumes that the rear head frame 32*b* is constructed so that one end thereof located near the head 31 serves as the friction member 41.

The head 21 in FIG. 4 is pressed by the spring against the platen roller 110, as earlier described. The ink sheet 42 is fed by relying solely on the rotating action of the platen roller 110. The ink sheet 42 is sandwiched between the head 31 and the platen roller 110. This is equivalent to holding the ink sheet 42 stationary under tension at the head 31. The take-up roller 15 takes up the printed portion of the ink sheet 42 with a strong rotational force. With this take-up tension, the friction member 41 can serve the function of frictionally tensioning the ink sheet when, as shown in FIG. 4, the rear head frame 32*b* is constructed so that the friction member 41 protrudes beyond a reference line L1 toward the platen roller side, i.e., below the reference line L1 in the plane of FIG. 4, the reference line L1 being the line joining the head 31 to the take-up position of the take-up roller 15.

In the present invention, the take-up tensional force applied to the ink sheet 42 at the print position of the head 31 is made greater at the widthwise edges of the ink sheet 42 than at the center thereof in order to prevent the ink sheet 42 from wrinkling with the center portion thereof shrinking due to the heating of the head 31 and thereby to prevent print failure. This also serves to prevent transport failure of the ink sheet 42.

The structure of the friction member 41 will be described in detail below. In the thermal transfer recording apparatus 3, the friction member 41, which forcefully applies a frictional force to a portion of the ink sheet 42 lying in the section between the head 31 and the take-up roller 15, is disposed between the head 31 and the take-up roller 15 and along the full width of the ink sheet. Further, the frictional force of the friction member 41 is made grater at the center than at both end portions thereof. With this structure, the tensile force applied to both edges of the portion of the ink sheet 42 which faces the head 31 can be made greater than that applied to the center of that portion.

There are several structures in which the frictional force of the friction member 41 can be made greater at the center than at both end portions thereof, for example, a first structure in which the length of contact between the ink sheet 42 and the friction member 41 is varied, a second structure in which the coefficient of friction of the friction member 41 is made lower at both end portions than at the center portion, and a third structure in which the coefficient of friction of the friction member 41 is made higher at the center portion than at both end portions. Specific methods of mounting will be presented below using several examples.

Figure 5:
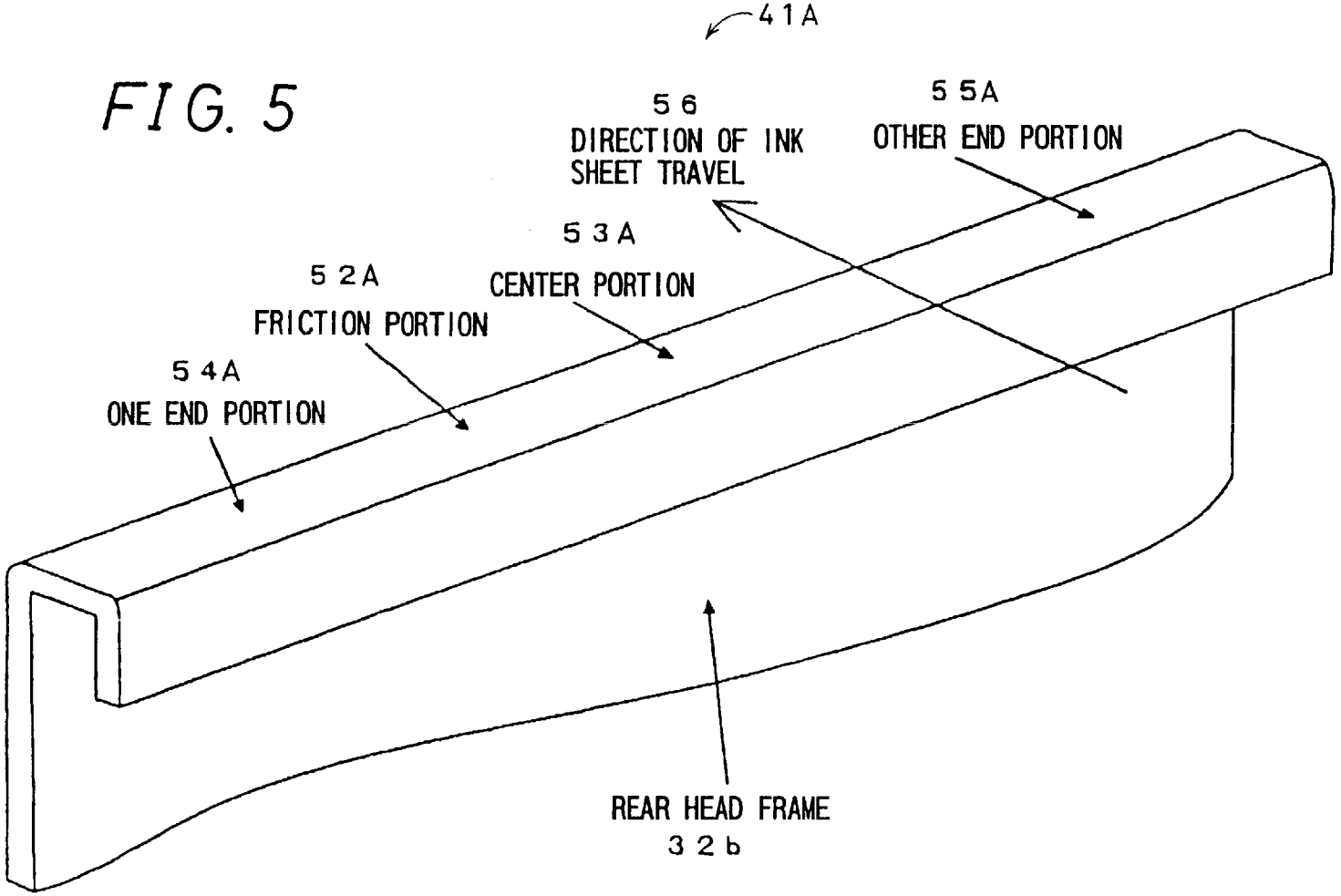
FIG. 5 is a perspective view showing in detail the basic structure of a friction member 41 contained in the thermal transfer facsimile apparatus of FIG. 1.

FIG. 5 is a detailed perspective view showing the friction member 41 of the basic structure. In this structure, the rear head frame 32*b* is used as the friction member 41. In FIG. 5, the friction member 41 is shown upside down from that shown in FIG. 4, and the ink sheet 42 is fed in the direction of ink sheet travel 56 shown by arrow 56. The rear head frame 32*b* is a member whose cross section cut along an imaginary plane perpendicular to the width direction of the ink sheet 42 is substantially formed in the shape of the letter L. Of all the surfaces of the rear head frame 32*b*, the surface most protruding beyond the reference line L1 toward the platen roller side is called a "friction portion". The friction portion is the surface that applies friction to the ink sheet 42. A friction member 51A of FIG. 5 is formed from uniform material, and the surface of the friction portion 52A is flat. The coefficient of friction at the center portion of a friction portion 52A in FIG. 5 is equal to that at both end portions thereof. The first to third structures forming friction members 41B to 41D in the present invention are identical to the structure of a friction member 41A shown in FIG. 5, the only difference being in the structure of the respective friction portions.

Figure 6:
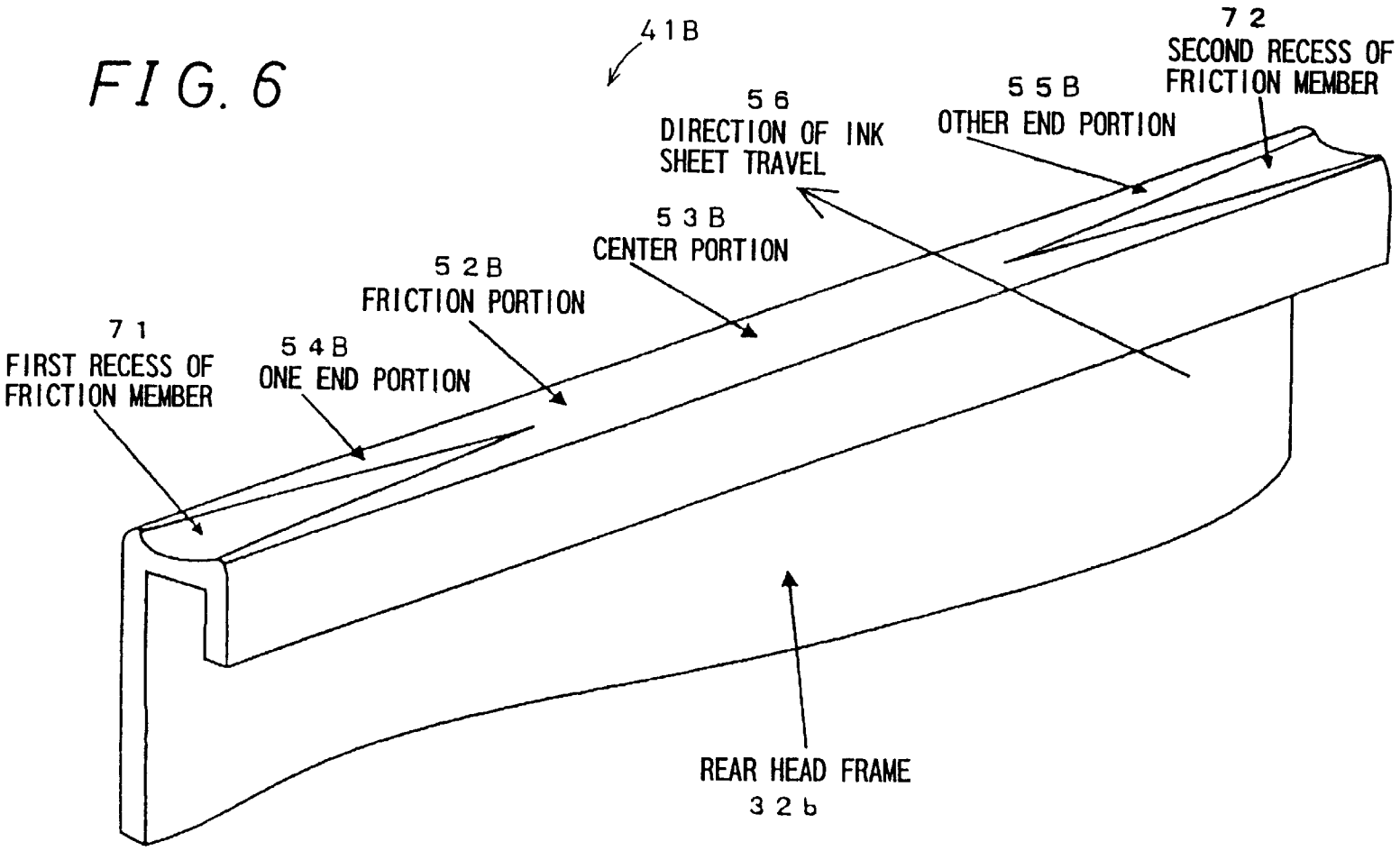
FIG. 6 is a perspective view showing a friction member of a structure in which the area of friction at both end portions is reduced.

FIG. 6 is a perspective view showing the friction member 41B of the first structure. In this structure, both end portions 54B and 55B of a friction portion 52B are recessed to provide lower faces than a center portion 53B; that is, a first recess 71 is formed in one end portion 54B of the friction portion 52B, and a second recess 72 is formed in the other end portion 55B thereof. In this way, the length along which the center portion 53B of the friction portion 52B of FIG. 6 contacts the ink sheet 42 is made greater than the length along which each of the end portions S4B and 55B of the friction portion 52B of FIG. 6 contacts the ink sheet 42, so that the center portion 53B of the friction member 41B of FIG. 6 provides a greater frictional force than that defined by the coefficient of friction of each of the end portions 54B and 55B of the friction member 41B. Accordingly, in the structure of the friction member 41B in FIG. 6, the tensile force applied to both widthwise edges of the ink sheet 42 can be made greater than that applied to the widthwise center thereof.

In FIG. 6, the recesses 71 and 72 in the respective end portions are formed widest at the respective ends, the width gradually decreasing toward the center of the friction portion 52B. With this gradually narrowing recess structure, the friction member 41B of FIG. 6 can gradually reduce the tensile force with increasing distance from each widthwise end toward the center.

Figure 7:
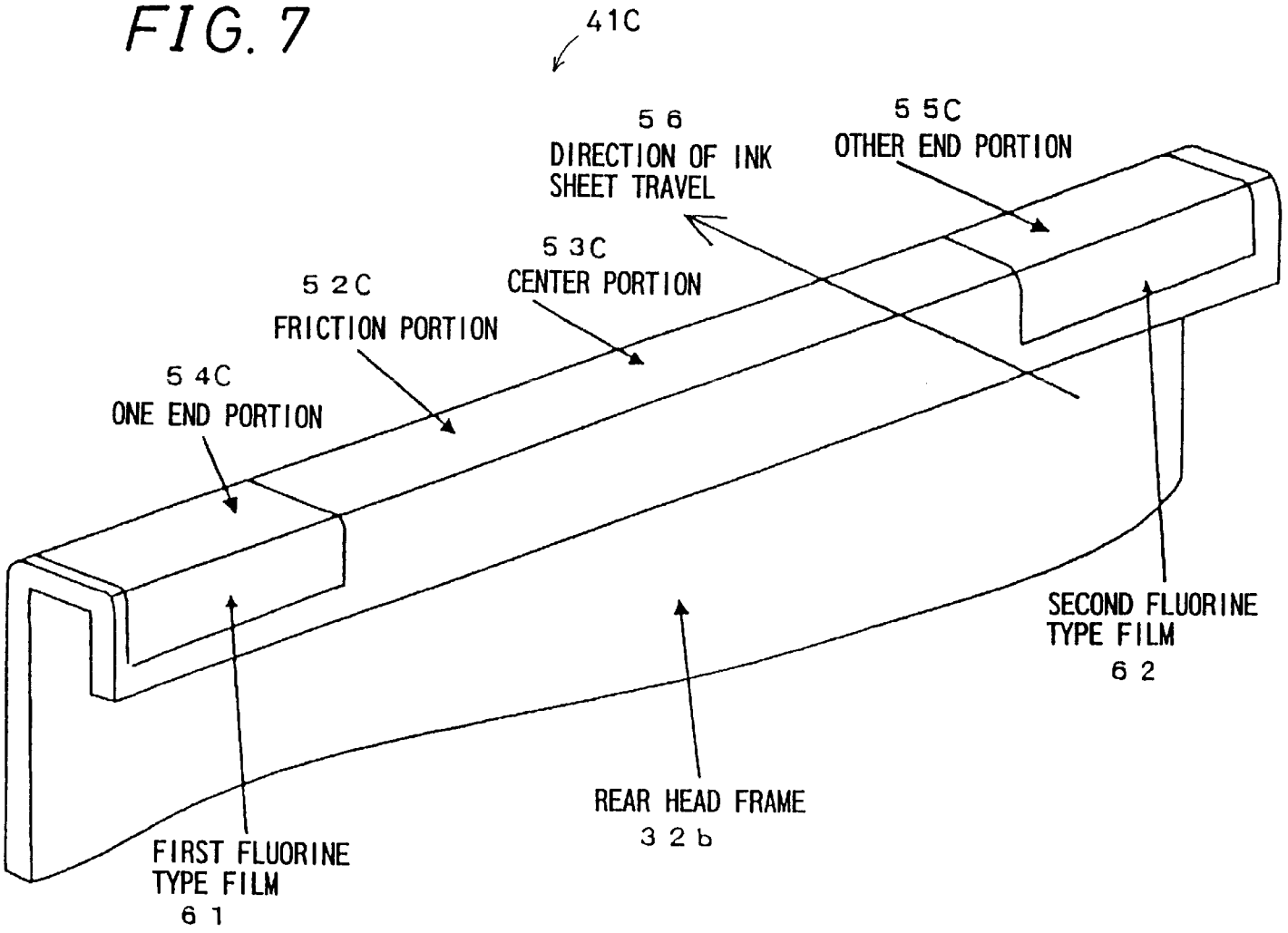
FIG. 7 is a perspective view showing a friction member of a structure in which a fluorine-based film is glued to each end portion.

FIG. 7 is a perspective view showing the friction member 41C of the second structure. In this structure, a first fluorine-based film 61 is glued to one end portion 54C of the friction portion and a second fluorine-based film 62 to the other end portion 55C. Generally, a fluorine-based film has a lower coefficient of friction than members made of other materials. Thus, the friction portion 52C of the friction member 41C in FIG. 7 has a lower coefficient of friction at both end portions 54C and 55C than at a center portion 53C, relatively. Accordingly, in the structure of the friction member 41C in FIG. 7, the tensile force applied to both widthwise edges of the ink sheet 42 can be made greater than that applied to the widthwise center thereof.

Figure 8:
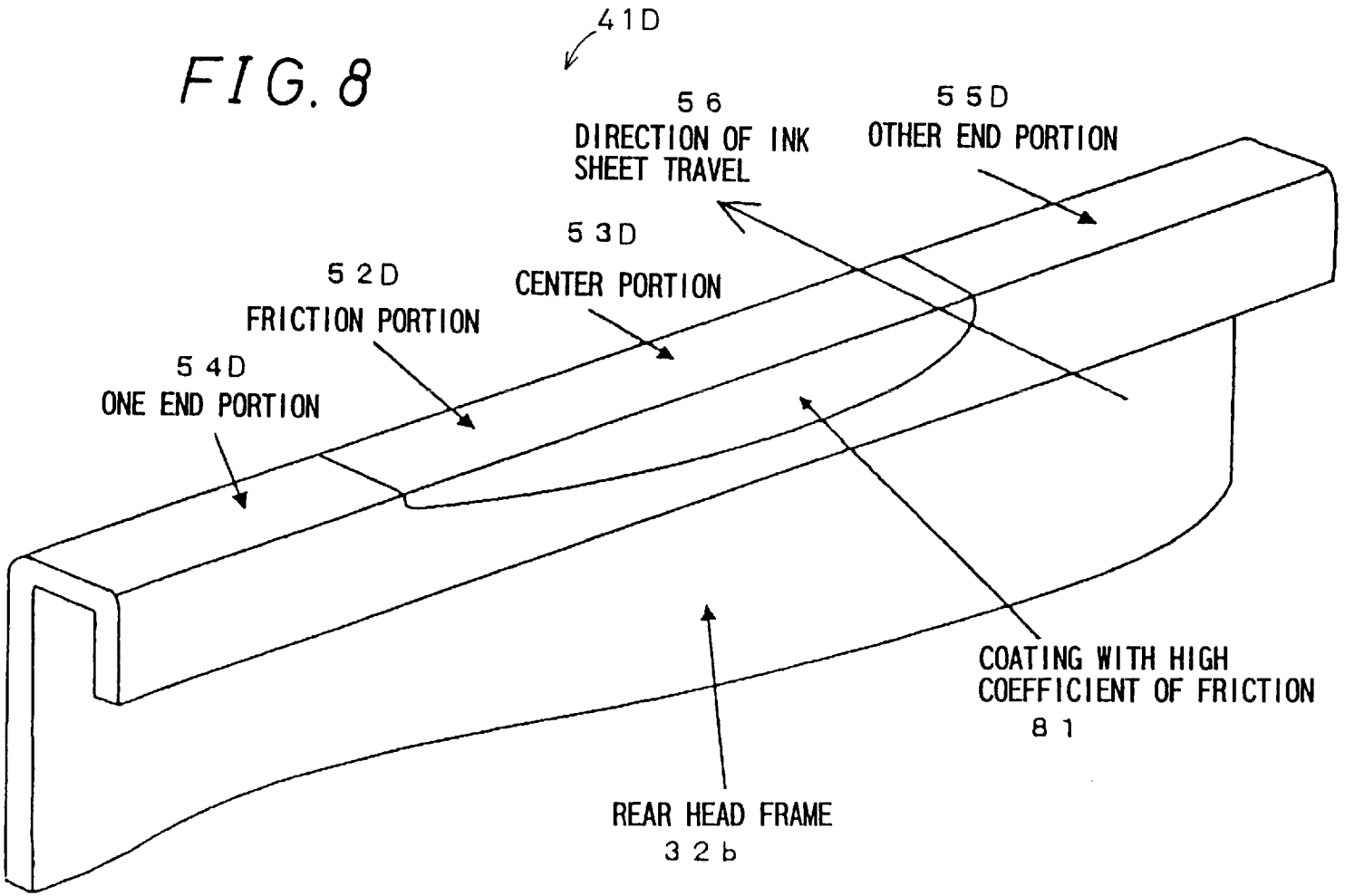
FIG. 8 is a perspective view showing a friction member of a structure in which the coefficient of friction at a center portion is increased.

FIG. 8 is a perspective view showing a friction member 41D of the third structure. In the friction member 41D of FIG. 8, a center portion 53D of a friction portion 52D is covered with a substance having a high coefficient of friction.

More specifically, a substance 81 with a high coefficient of friction is applied only on the center portion 53D of the friction portion. This serves to reduce surface smoothness of the center portion of the friction portion 52D; as a result, the friction portion 52D of the friction member 41D in FIG. 8 has a lower coefficient of friction at both end portions 54D and 55D than at the center portion 53D, relatively. Accordingly, in the structure of the friction member 41D in FIG. 8, the tensile force applied to both widthwise edges of the ink sheet 42 can be made greater than that applied to the widthwise center thereof. When adjusting the frictional force by treating only the center portion 53D of the friction portion, a film with a high coefficient of friction may be glued to the center portion 53D of the friction portion, or the surface of the center portion 53D of the friction portion may be roughened using a sand blasting or like method. With such treatment, in the structure of the friction member 41D in FIG. 8, the tensile force applied to both widthwise edges of the ink sheet 42 can be made greater than that applied to the widthwise center thereof.

In the usual printing process, the widthwise center portion of the ink sheet 42 is frequently used for printing, increasing the tendency of the center portion of the ink sheet to shrink due to subjection to the heat of the thermal head 31. Both edges of the ink sheet include portions not used for printing and, therefore, are less likely to be subjected to the heat of the head 31. By designing the thermal recording apparatus 3 so that both widthwise edges of the ink sheet 42 is pulled with a greater tensile force than the center portion thereof is pulled and so that the direction vector of pulling is made to direct outward, transport failure of the ink sheet due to shrinking can be prevented, ensuring proper transportation of the ink sheet 42; furthermore, it becomes possible to prevent the ink sheet from wrinkling due to shrinking.

A realistic approach to achieving a structure that can apply a greater tensile force to both edges of the ink sheet than the center thereof is to reduce the ink sheet take-up force by friction and vary the rate of reduction between the widthwise center and the widthwise edges of the ink sheet. Accordingly, in the thermal transfer recording apparatus of the embodiment, the friction member for tensioning the ink sheet by forcefully applying friction to it is constructed so as to contact the full width of the ink sheet, and the frictional force of the friction member is made smaller at both end portions than at the center portion so that a greater tensile force is applied to both edge of the ink sheet. To achieve the purpose, in the specific structure shown in FIG. 6, the width of the friction member for providing friction is varied in such a manner as to increase the length of contact along which the ink sheet contacts the center portion. In FIGS. 7 and 8, the coefficient of friction of the friction member is varied between the center portion and the end portions to achieve the above purpose.

Figure 9:
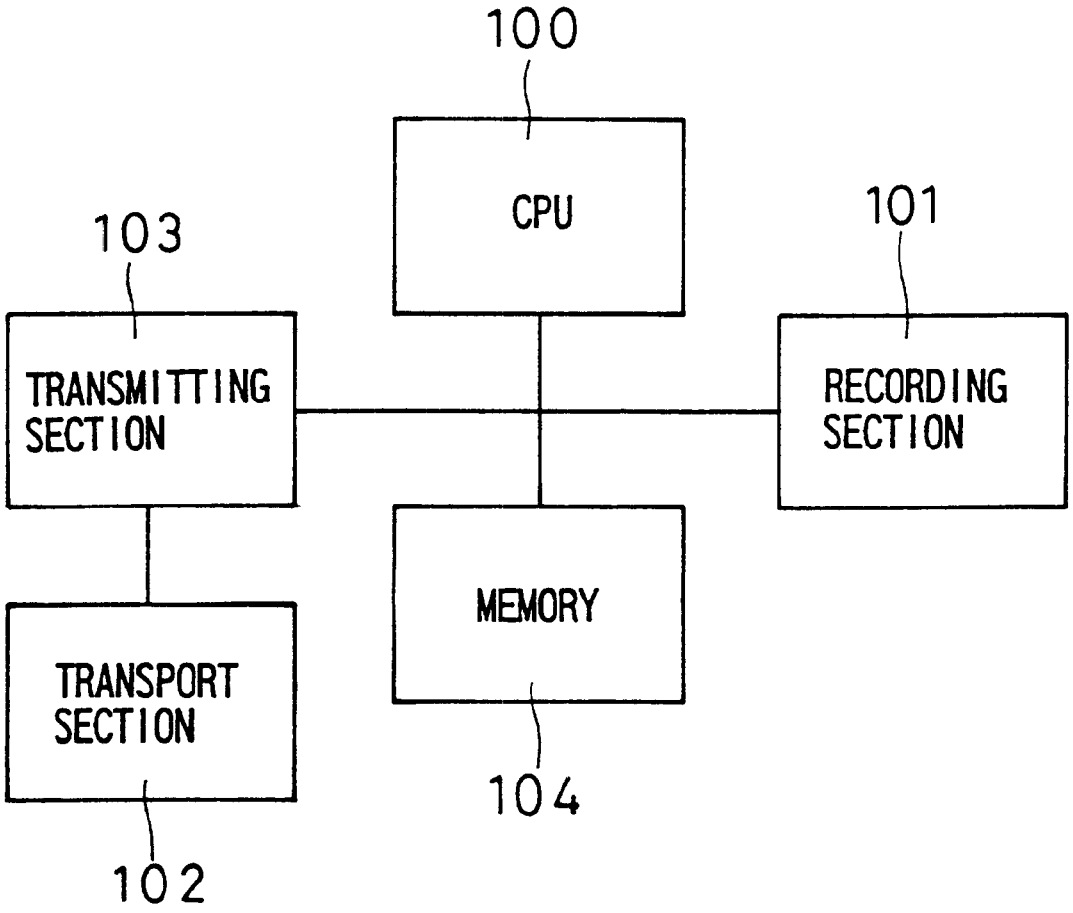
FIG. 9 is a block diagram showing the electrical configuration of the thermal transfer facsimile apparatus according to the present invention.

FIG. 9 is a block diagram showing the electrical configuration of the above-described thermal transfer facsimile apparatus according to the present invention. A brief description of the facsimile apparatus will be given with reference to FIG. 9. The illustrated configuration concerns a conventional facsimile, and various other embodiments are also possible. The thermal transfer facsimile apparatus comprises a CPU 100, a document transport section 102, a document transmitting section 103, and a memory 104, in addition to the communications device 4 and a recording section 101 which includes the thermal transfer recording apparatus 3. The CPU 100 controls the functions of the devices 4 and 101 to 104 in the facsimile apparatus. The recording section 101 records images received by the communications device 4 onto the recording paper. The recording section 101 includes a thermal head driver. The document transport section 102 transports a document holding thereon an image to be transmitted. The document transmitting section 103 transmits the document via the communications device 4. The document transmitting section includes the document reading device. The memory 104 is used to store received images as well as abbreviated dialing and speed dialing numbers.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A thermal transfer recording apparatus comprising:

a thermal head;

a platen roller opposed to the thermal head, the thermal transfer recording apparatus carrying out printing on a sheet by causing a printing ink such as a wax or a sublimation dye, applied on an ink sheet, to melt or sublime by the heat of the thermal head, the ink sheet being transported between the thermal head and the platen roller; and a head frame containing the thermal head, a portion of the head frame itself applying friction to a portion of the ink sheet which lies downstream of the thermal head as viewed along a direction of ink sheet travel, a center portion of said head frame portion having a coefficient of friction that is higher than a coefficient of friction at both end portions of said head frame portion, whereby a tensile force is applied to the ink sheet that is greater at both edges of the ink sheet than at the center thereof.

2. The thermal transfer recording apparatus of claim 1, wherein the head frame portion for applying a tensile force is a friction member for tensioning the ink sheet by applying the friction to the ink sheet, and wherein the friction member is disposed downstream of the thermal head as viewed along the direction of travel, a contact face of the friction member that is brought into contact with the ink sheet extends along full width of the ink sheet, and a coefficient of friction at a center portion of the contact face of the friction member is higher than coefficients of friction at both end portions of the contact face.

3. The thermal transfer recording apparatus of claim 2, wherein the length of contact along which the center portion of the contact face of the friction member contacts the ink sheet is greater than a length of contact along which each of the end portions of the contact face of the friction member contacts the ink sheet.

4. The thermal transfer recording apparatus of claim 3, wherein the length of contact along which each of the end portions of the contact face of the friction member contacts the ink sheet increases with increasing distance from each end of the contact face toward the center thereof.

5. The thermal transfer recording apparatus of claim 2, wherein both end portions of the contact face of the friction member are each covered with a substance whose coefficient of friction is lower than the coefficient of friction of the center portion of the contact face.

6. The thermal transfer recording apparatus of claim 2, wherein the center portion of the contact face of the friction member is covered with a substance whose coefficient of friction is higher than the coefficient of friction of both end portions of the contact face.

7. The thermal transfer recording apparatus of claim 2, wherein a film made of a substance whose coefficient of friction is higher than the coefficient of friction of both end portions of the contact face of the friction member is glued to the center portion of the contact face.

8. The thermal transfer recording apparatus of claim 2, wherein the center portion of the contact face of the friction member is treated with surface roughening.

9. A thermal transfer recording apparatus for printing on printing media such as sheets of paper comprising a thermal head;

a platen roller opposed to the thermal head;

an ink sheet for printing on printing the printing media;

a take-up roller for transporting the ink sheet between the thermal head and platen roller; and a head frame containing the thermal head, a portion of the head frame itself including a friction member for tensioning the ink sheet by applying to the ink sheet friction that is higher in the center than that applied at both ends, the friction member having a contact face that contacts the ink sheet, and wherein a tensile force applied to a portion of the ink sheet which lies downstream of the thermal head as viewed along a direction of ink sheet travel is caused by said application of friction to be greater at both edges of the ink sheet than at the center of the ink sheet.

10. The thermal transfer recording apparatus of claim 9, wherein length of contact along which the center portion of the contact face of the friction member contacts the ink sheet is greater than a length of contact along which each of the end portions of the contact face of the friction member contacts the ink sheet.

11. The thermal transfer recording apparatus of claim 9, wherein the length of contact along which each of the end portions of the contact face of the friction member contacts the ink sheet increases with increasing distance from each end of the contact face toward the center thereof.

12. The thermal transfer recording apparatus of claim 9, wherein both end portions of the contact face of the friction member are each covered with a substance whose coefficient of friction is lower than the coefficient of friction of the center portion of the contact face.

13. The thermal transfer recording apparatus of claim 9, wherein the center portion of the contact face of the friction member is covered with a substance whose coefficient of friction is higher than the coefficient of friction of both end portions of the contact face.

14. The thermal transfer recording apparatus of claim 9, wherein a film made of a substance whose coefficient of friction is higher than the coefficient of friction of both end portions of the contact face of the friction member is glued to the center portion of the contact face.

15. The thermal transfer recording apparatus of claim 9, wherein the center portion of the contact face of the friction member is treated with surface roughening.

16. The thermal transfer recording apparatus of claim 9 wherein said head frame includes a front frame and a rear frame, the rear frame being the head frame portion including the friction member.

17. A thermal transfer recording apparatus for printing on printing media such as sheets of paper comprising a thermal head;

a platen roller opposed to the thermal head;

an ink sheet for printing on printing the printing media;

a take-up roller for transporting the ink sheet between the thermal head and platen roller; and a head frame containing the thermal head, a portion of the head frame itself including a friction member for tensioning the ink sheet by applying friction to the ink sheet, the friction member having recesses in both end portions thereof, each of the recesses having a width gradually decreasing toward a center portion of the friction member so that the friction applied to the ink sheet is higher in the center than that applied at both ends, and wherein a tensile force applied to a portion of the ink sheet which lies downstream of the thermal head as viewed along a direction of ink sheet travel is caused by said application of friction to be greater at both edges of the ink sheet than at the center of the ink sheet.

* * * * *